US011635717B2

(12) United States Patent
Maeda et al.

(10) Patent No.: US 11,635,717 B2
(45) Date of Patent: Apr. 25, 2023

(54) ELECTROPHOTOGRAPHIC MEMBER AND METHOD FOR MANUFACTURING THE SAME, THERMAL FIXING APPARATUS, AND ELECTROPHOTOGRAPHIC IMAGE FORMING APPARATUS

(71) Applicant: CANON KABUSHIKI KAISHA, Tokyo (JP)

(72) Inventors: Matsutaka Maeda, Kanagawa (JP); Yuji Kitano, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/590,165

(22) Filed: Feb. 1, 2022

(65) Prior Publication Data

US 2022/0260945 A1 Aug. 18, 2022

(30) Foreign Application Priority Data

Feb. 12, 2021 (JP) ..... JP2021-021314

(51) Int. Cl.
*G03G 15/20* (2006.01)

(52) U.S. Cl.
CPC ..... *G03G 15/2057* (2013.01)

(58) Field of Classification Search
CPC ..... G03G 15/2057; G03G 15/206
See application file for complete search history.

(56) References Cited

U.S. PATENT DOCUMENTS

| | | | | |
|---|---|---|---|---|
| 7,537,838 | B2 | 5/2009 | Hirabayashi et al. | |
| 10,545,439 | B2 | 1/2020 | Matsumoto et al. | |
| 10,620,574 | B2 | 4/2020 | Kitano et al. | |
| 10,712,697 | B2 | 7/2020 | Maeda et al. | |
| 10,845,743 | B2 | 11/2020 | Abe et al. | |
| 10,859,956 | B2 | 12/2020 | Maeda et al. | |
| 10,890,869 | B2 | 1/2021 | Miyahara et al. | |
| 2011/0082260 | A1* | 4/2011 | Omata | G03G 15/206 525/276 |
| 2013/0164060 | A1* | 6/2013 | Honke | G03G 15/2057 428/32.81 |
| 2016/0091841 | A1* | 3/2016 | Matsumoto | G03G 15/2057 156/247 |
| 2016/0109834 | A1* | 4/2016 | Kadowaki | G03G 15/206 399/329 |
| 2017/0139373 | A1* | 5/2017 | Honke | G03G 15/2064 |
| 2019/0377285 | A1 | 12/2019 | Matsumoto et al. | |
| 2019/0377290 | A1 | 12/2019 | Kitano et al. | |
| 2019/0377291 | A1 | 12/2019 | Maeda et al. | |
| 2020/0117127 | A1 | 4/2020 | Abe et al. | |
| 2020/0333737 | A1 | 10/2020 | Maeda et al. | |
| 2020/0371460 | A1 | 11/2020 | Miyahara et al. | |
| 2022/0075296 | A1 | 3/2022 | Kitano et al. | |

FOREIGN PATENT DOCUMENTS

| | | | |
|---|---|---|---|
| JP | 8-27313 | A | 1/1996 |
| JP | 2007-171946 | A | 7/2007 |
| JP | 2020-177233 | A | 10/2020 |

* cited by examiner

*Primary Examiner* — Sandra Brase
(74) *Attorney, Agent, or Firm* — Venable LLP

(57) ABSTRACT

An electrophotographic member comprising a base body and an elastic layer on the base body, the elastic layer including silicone rubber and metallic silicon particles in the silicone rubber; wherein the metallic silicon particles have a mass reduction rate of 0.05% or more.

8 Claims, 5 Drawing Sheets

ELECTROPHOTOGRAPHIC MEMBER AND METHOD FOR MANUFACTURING THE SAME, THERMAL FIXING APPARATUS, AND ELECTROPHOTOGRAPHIC IMAGE FORMING APPARATUS

BACKGROUND

The present disclosure relates to an electrophotographic member for use in a thermal fixing apparatus of an electrophotographic image forming apparatus, and a thermal fixing apparatus and an electrophotographic image forming apparatus having the electrophotographic member. In addition, the present disclosure relates to a method for manufacturing the electrophotographic member.

DESCRIPTION OF THE RELATED ART

In a thermal fixing apparatus of an electrophotographic image forming apparatus, a pressure contact portion is formed by a heating member and a pressing member which is arranged so as to face the heating member. When a recorded material which retaining an unfixed toner image thereon is introduced into the pressure contact portion, the unfixed toner is heated and pressurized, the toner is melted, and the image is fixed on the recorded material. The heating member is a member with which an unfixed toner image on the recorded material comes into contact, and the pressing member is a member which is arranged so as to face the heating member. The shape of the electrophotographic member is, for example, a rotatable shape such as a roller shape and an endless belt shape. The electrophotographic member may have an elastic layer containing, for example, rubber such as cross-linked silicone rubber and a thermally conductive particles, on a substrate made of metal or a heat-resistant resin.

In recent years, faster print speeds and shorter start-up times have been on an increasing trend. Accompanying with the trend, the elastic layer is required to have high thermal conductivity and low thermal capacity. Japanese Patent Application Laid-Open No. 2007-171946 discloses a heat fixing roll and a heat fixing belt provided with an elastic layer made from a silicone rubber composition containing metallic silicon particles. However, in order to obtain the elastic layer having even higher thermal conductivity, a silicone rubber composition containing a larger amount of metallic silicon particles, is employed to form the elastic layer, there is a case that a durability of the resultant elastic layer decreases.

SUMMARY

At least one aspect of the present disclosure is directed to providing an electrophotographic member having high thermal conductivity, low thermal capacity and excellent durability, and a thermal fixing apparatus and an electrophotographic image forming apparatus having the electrophotographic member.

According to one aspect of the present disclosure, there is provided an electrophotographic member, including: a base body; and an elastic layer on the base body, wherein the elastic layer includes silicone rubber and metallic silicon particles in the silicone rubber; and wherein the metallic silicon particles have a mass reduction rate of 0.05% or more, the mass reduction rate being determined by: (i) collecting 2 g of a sample from the elastic layer; (ii) immersing the sample into 50 ml of a normal propyl bromide liquid containing dodecylbenzene sulfuric acid at a concentration of 10 wt % and having a temperature of 40° C., and applying an ultrasonic wave of 40 kHz for 60 minutes to dissolve the silicone rubber of the sample; (iii) extracting the metallic silicon particles, and then subjecting the metallic silicon particles extracted to vacuum filtration washing three times with 10 ml of toluene at a temperature of 25° C.; and (iv) subjecting the metallic silicon particles resulting from the step (iii) to a thermogravimetric analysis and measuring the mass reduction rate in temperature range of from 300° C. to 500° C.

According to another aspect of the present disclosure, there is provided a thermal fixing apparatus including a heating member and a pressing member that heats a recording material having an unfixed toner image thereon at a nip portion that is formed by the heating member and the pressing member to fix the unfixed toner image on the recording material, wherein the heating member is the aforementioned electrophotographic member.

According to another aspect of the present disclosure, there is provided an electrophotographic image forming apparatus having the aforementioned thermal fixing apparatus.

According to further aspect of the present disclosure, there is provided a method for manufacturing the electrophotographic member, comprising:

mixing a silicone component containing organopolysiloxane with a metallic silicon powder, and allowing the obtained mixture to stand still for 30 days or longer to prepare a liquid silicone rubber composition;

applying the liquid silicone rubber composition onto a base body to form a layer of the composition; and curing the layer of the composition to form an elastic layer.

According to still further aspect of the present disclosure, there is provided a method for manufacturing the electrophotographic member, comprising:

mixing a silicone component containing organopolysiloxane with a metallic silicon powder using a planetary mixer under conditions of a revolution speed of 5 to 15 rpm and a mixing time of 100 to 300 minutes, and allowing the obtained mixture to stand still for 4 days or longer to prepare a liquid silicone rubber composition;

applying the liquid silicone rubber composition onto a base body to form a layer of the composition; and curing the layer of the composition to form an elastic layer.

Further features of the present invention will become apparent from the following description of exemplary embodiments with reference to the attached drawings.

BRIEF DESCRIPTION OF THE DRAWINGS

FIG. 1A illustrates a schematic cross-sectional view of a belt-shaped fixing member, and FIG. 1B illustrates a schematic cross-sectional view of a roller-shaped fixing member.

DESCRIPTION OF THE EMBODIMENTS

Figure 1A:
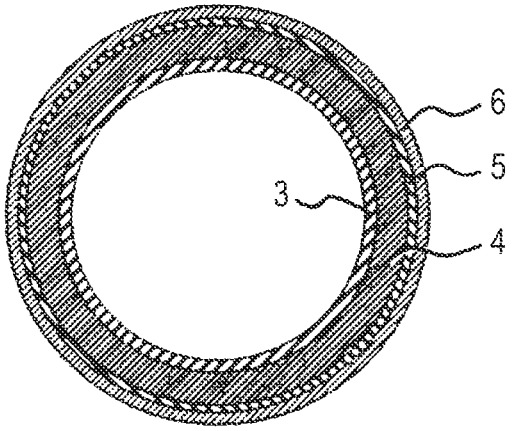
FIGS. 1A and 1B illustrate a schematic cross-sectional view of a fixing member according to two aspects of the present disclosure. In the figure.

In the present disclosure, the description indicating a numerical range such as "XX or more and YY or less" and "XX to YY", means a numerical range that includes a lower limit and an upper limit which are endpoints, unless otherwise specified. Further, when the numerical ranges are described step by step, any combinations of the upper limit and the lower limit of each of the numerical ranges are disclosed.

In the present disclosure, the electrophotographic member encompasses, for example, the heating member and the pressing member.

Preferred embodiments of the present invention will now be described in detail in accordance with the accompanying drawings.

The reason why the elastic layer made from a silicone rubber composition contained a larger quantity of metallic silicon particles, shows lower durability, is considered as follows. An elastic layer of the fixing belt or fixing roll is subjected to repeated compression by paper feeding under heating. In particular, the elastic layer is subjected to large deformation and strong compression at a contact portion with an edge of the paper. As the proportion of the thermally conductive particles such as the metallic silicon particles in the elastic layer increases, the proportion of the rubber decreases relatively. As a result of that, the elastic layer is compressed and thereby is deformed, the deformation of the rubber portion increases. When the deformation of the rubber portion increases, stress is concentrated particularly at the interface between the metallic silicon particles and the rubber surrounding the metallic silicon particles, and finally the rubber portion is broken. As a method of increasing the strength of the interface between the thermally conductive particles and the rubber portion, it is considered to subject the metallic silicon particles to surface treatment by using a silane coupling agent. However, each of metallic silicon particles has few surface functional groups, and it is considered that an effect of surface treatment by a silane coupling agent is considered to be limited.

Based on the aforementioned consideration, further study have been conducted, and the present inventors have found that the strength of the interface between the metallic silicon particles and the rubber portion can be enhanced by forming "bound rubber" on the surface of the metallic silicon particles, and also have found that the elastic layer in which metallic silicon particles having the bound rubber on the surface thereof shows excellent durability.

The bound rubber is known in a tire industry. That is, in a rubber composition containing a rubber and carbon black, the bound rubber is observed on the carbon black. Specifically, when the carbon black is extracted from an unvulcanized rubber composition containing the carbon black, by use of a solvent of which the unvulcanized rubber is soluble, there is the rubber which is not extracted since it is bound to the carbon black. The rubber bound to the carbon black is referred to as the "bound rubber". (See Japanese Patent Application Laid-Open No. H08-27313).

The present inventors have found that, in the silicone rubber composition containing the metallic silicon particles, the bound rubber can be formed on the metallic silicon particles. Further, as mentioned above, the elastic layer containing the metallic silicon particles on the surface of which the bound rubber is formed, show excellent durability even when a large amount of the metallic silicon particles is contained in the elastic layer. The present inventors have extracted the metallic silicon particles from the elastic layer of the electrophotographic member according to the present disclosure by using a specific extracting process, and measured the amount of the silicone rubber which is still bonded to the extracted metallic silicon particles by the thermogravimetric analysis, and the amount of the silicone rubber which is still bonded to the extracted metallic silicon particles is defined as the amount of the bound rubber. As a result, it has been found that the greater the amount of the bound rubber, the greater the rupture energy of the elastic layer is and the more excellent the durability is. Thus, the metallic silicon particles in the elastic layer of the electrophotographic photosensitive member according to one aspect of the present disclosure, a large amount of the silicone rubber is bonded as the bound rubber. It is considered that as a result, the affinity between the metallic silicon particles and the silicone rubber serving as the matrix is increased in which the metallic silicon particles are dispersed, and the breakage of the silicone rubber is suppressed at the interface between the metallic silicon particles and the silicone rubber.

In the present disclosure, the amount of the bound rubber is defined as a mass reduction rate in a specific temperature range in the thermogravimetric analysis of the metallic silicon particles that have been extracted from the elastic layer (cured product of liquid silicone rubber composition) by a specific method.

In other words, in the electrophotographic member according to one aspect of the present disclosure, the "mass reduction rate" is 0.05% or more, as the amount of the bound rubber of the metallic silicon particles that are contained in the elastic layer.

It is considered that in the elastic layer according to the present disclosure, due to the mass reduction rate of the metallic silicon particles being 0.05% or more, a large amount of the silicone rubber serving as the bound rubber is in a state of being bonded to the metallic silicon particles. As a result, the electrophotographic member including the elastic layer according to the present disclosure becomes excellent in durability.

The electrophotographic member and the thermal fixing apparatus according to one embodiment of the present disclosure will be described in detail below, based on specific configurations.

(1) Outline of Configuration of Electrophotographic Member

The electrophotographic member of the present embodiment will be described in detail with reference to the drawings.

The electrophotographic member according to one aspect of the present disclosure can be, for example, a rotatable member having a roller shape or an endless belt shape (hereinafter also referred to as "fixing roller" or "fixing belt", respectively).

Figure 1B:
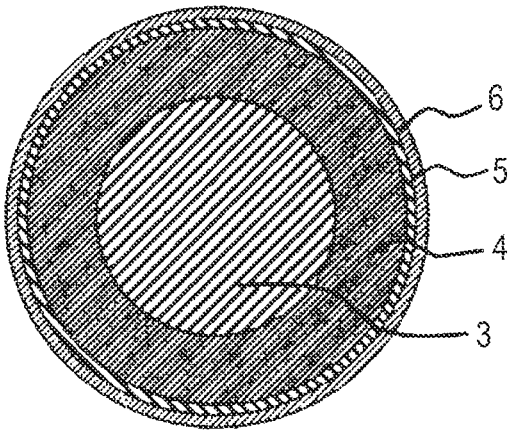

FIG. 1A illustrates a cross-sectional view of the fixing belt in a circumferential direction, and FIG. 1B illustrates a cross-sectional view of the fixing roller in a circumferential direction. As shown in FIG. 1A and FIG. 1B, the electrophotographic member includes a base body 3, an elastic layer 4 on the outer surface of the base body 3, and a surface layer (release layer) 6 on the outer surface of the elastic layer 4. In addition, as an option layer, an adhesive layer 5 may be provided between the elastic layer 4 and the surface layer 6.

In this case, the surface layer 6 is fixed to the outer peripheral surface of the elastic layer 4 by the adhesive layer 5.

(2) Base body

The material of the base body is not particularly limited, and materials known in the field of the electrophotographic member can be appropriately used. Examples of the material constituting the base body include: metals such as aluminum, iron, nickel and copper; alloys such as stainless steel; and resins such as polyimide.

Here, in the case where the thermal fixing apparatus is a thermal fixing apparatus that heats the base body by an induction heating method as a heating unit of the electrophotographic member, the base body is formed from at least one of metals selected from the group consisting of nickel, copper, iron and aluminum. Among those metals, an alloy containing nickel or iron as a main component may preferably be used, particularly from the viewpoint of heat generation efficiency. Note that the main component means a component that is contained most in the components constituting an object (here, base body).

The shape of the base body can be appropriately selected according to a shape of the electrophotographic member, and various shapes can be employed, such as an endless belt shape, a hollow cylindrical shape, a solid cylindrical shape and a film shape.

In the case of the fixing belt, it is preferable that the thickness of the base body is, for example, 15 to 80 μm. Due to the thickness of the base body being set within the above range, both strength and flexibility can be achieved at a high level.

In addition, on the surface of the base body opposite to a side facing the elastic layer, for example, there can be provided a layer for preventing abrasion of the inner peripheral surface of the fixing belt, or a layer for enhancing slidability with another member, in the case where the inner peripheral surface of the fixing belt comes in contact with another member.

(3) Elastic Layer

The elastic layer is a layer for imparting flexibility to the electrophotographic member in order to secure a fixing nip in the thermal fixing apparatus. Note that in the case where the electrophotographic member is used as a heating member in contact with toner on paper, the elastic layer functions also as a layer for imparting such flexibility that the surface of the heating member can follow irregularities of the paper. The elastic layer includes a rubber serving as a matrix and particles dispersed in the rubber. More specifically, the elastic layer includes the rubber and a thermally conductive particles; and is formed of a cured product that is obtained by curing a composition containing at least a raw material of rubber (base polymer, cross-linking agent and the like) and the thermally conductive particle.

From the viewpoint that the elastic layer develops the above described functions, it is preferable for the elastic layer to be formed of a cured product of liquid silicone rubber containing the thermally conductive particle, and is more preferable to be formed of a cured product of an addition-curable type of liquid silicone rubber composition. The silicone rubber composition can include, for example, the thermally conductive particle, a base polymer, the cross-linking agent, a catalyst, and if necessary, an additive. The silicone rubber composition is liquid in many cases, which is preferable because the thermally conductive particles are easily dispersed therein, and the elasticity of the elastic layer to be produced can be easily adjusted, by adjustment of the degree of cross-linking of the silicone rubber, according to the type and the amount of the thermally conductive particles to be added.

The matrix bears the function of developing the elasticity in the elastic layer. From the viewpoint that the matrix develops the above function of the elastic layer, it is preferable that the matrix contains the silicone rubber. The silicone rubber is preferable because of having such a high heat resistance as to be capable of retaining flexibility, even in an environment in which the temperature is as high as about 240° C. in a region of paper non-passing part. As the silicone rubber, for example, a cured product of an addition-curable type of liquid silicone rubber composition can be used which will be described later.

The liquid silicone rubber composition usually includes the following components (a) to (d).

Component (a): an organopolysiloxane having an unsaturated aliphatic group;

Component (b): an organopolysiloxane having an active hydrogen atom bonded to a silicon atom;

Component (c): a catalyst; and

Component (d): the metallic silicon particles.

Each component will be described below. Note that components (a) to (c) may be collectively referred to as a silicone component.

Component (a)

The organopolysiloxane having the unsaturated aliphatic group is an organopolysiloxane having an unsaturated aliphatic group such as a vinyl group, and examples thereof include organopolysiloxanes represented by the following structural formula (1) and structural formula (2).

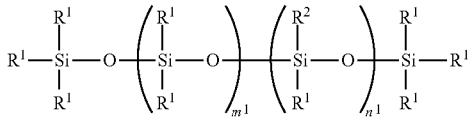

(1)

In the structural formula (1), $m^1$ represents an integer of 0 or larger, and $n^1$ represents an integer of 3 or larger. In addition, in the structural formula (1), $R^1$ each independently represents a monovalent unsubstituted or substituted hydrocarbon group that does not contain an unsaturated aliphatic group, provided that at least one of $R^1$ represents a methyl group, and $R^2$ each independently represents an unsaturated aliphatic group.

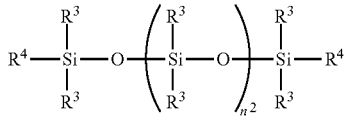

(2)

In the structural formula (2), $n^2$ represents a positive integer, $R^3$ each independently represents a monovalent unsubstituted or substituted hydrocarbon group which does not contain an unsaturated aliphatic group, provided that at least one of $R^3$ represents a methyl group, and $R^4$ each independently represents an unsaturated aliphatic group.

Examples of the monovalent unsubstituted or substituted hydrocarbon group which does not include the unsaturated aliphatic group and which can be represented by $R^1$ and $R^3$, in the structural formula (1) and the structural formula (2), include the following groups.

Unsubstituted Hydrocarbon Groups

Alkyl groups (for example, methyl group, ethyl group, propyl group, butyl group, pentyl group and hexyl group).

Aryl groups (for example, phenyl group).

Substituted Hydrocarbon Group

Substituted alkyl groups (for example, chloromethyl group, 3-chloropropyl group, 3,3,3-trifluoropropyl group, 3-cyanopropyl group and 3-methoxypropyl group).

The organopolysiloxanes represented by the structural formula (1) and the structural formula (2) usually have at least one methyl group that is directly bonded to a silicon atom which forms a chain structure. However, it is preferable that 50% or more of $R^1$ and $R^3$ are the methyl groups, respectively, and it is more preferable that all of $R^1$ and $R^3$ are methyl groups, because synthesis and handling are easy.

Examples of the unsaturated aliphatic group that can be represented by $R^2$ and $R^4$ in the structural formula (1) and the structural formula (2) include the following groups. Specifically, examples of the unsaturated aliphatic group include a vinyl group, an allyl group, a 3-butenyl group, a 4-pentenyl group, and a 5-hexenyl group. Among these groups, both $R^2$ and $R^4$ are preferably vinyl groups, because synthesis and handling are easy and inexpensive, and the cross-linking reaction is easily carried out.

It is preferable that the viscosity of the component (a) is 1000 $mm^2/s$ or higher and 50000 $mm^2/s$ or lower, from the viewpoint of formability. When the viscosity is 1000 $mm^2/s$ or higher, it is easy to adjust the hardness to a necessary hardness for the elastic layer, and when the viscosity is 50000 $mm^2/s$ or lower, the viscosity of the composition becomes a viscosity at which coating is easy. The viscosity (kinematic viscosity) can be measured by using a capillary viscometer, a rotary viscometer or the like, based on JIS Z 8803: 2011.

It is preferable that the amount of the component (a) blended is 55% by volume or more from the viewpoint of the durability, and is 65% by volume or less from the viewpoint of heat transfer properties, based on the liquid silicone rubber composition which is used in the formation of the elastic layer.

Component (b)

The organopolysiloxane having the active hydrogen atom bonded to silicon atom (Si—H bond) reacts with the unsaturated aliphatic group of the component (a) by an action of the catalyst, and functions as a cross-linking agent which forms a cured silicone rubber.

As the component (b), any organopolysiloxane can be used as long as the organopolysiloxane has a Si—H bond. In particular, an organopolysiloxane is suitably used in which an average number of hydrogen atoms bonded to silicon atoms (Si—H bonds) in one molecule is 3 or more, from the viewpoint of reactivity with the unsaturated aliphatic group of the component (a).

Specific examples of the component (b) include a linear organopolysiloxane represented by the following structural formula (3) and a cyclic organopolysiloxane represented by the following structural formula (4).

(3)

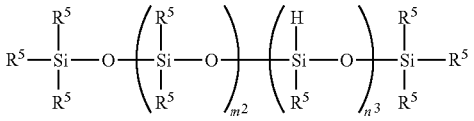

In the structural formula (3), $m^2$ represents an integer of 0 or larger, $n^3$ represents an integer of 3 or larger, and $R^5$ each independently represents a monovalent unsubstituted or substituted hydrocarbon group that does not contain an unsaturated aliphatic group.

(4)

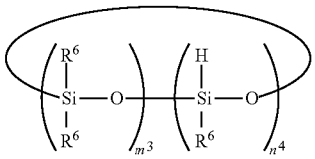

In the structural formula (4), $m^3$ represents an integer of 0 or larger, $n^4$ represents an integer of 3 or larger, and $R^6$ each independently represents a monovalent unsubstituted or substituted hydrocarbon group that does not contain an unsaturated aliphatic group.

Examples of the monovalent unsubstituted or substituted hydrocarbon group which does not include the unsaturated aliphatic group and which can be represented by $R^5$ and $R^6$ in the structural formula (3) and the structural formula (4) include the groups similar to $R^1$ in the above described structural formula (1). Among these groups, it is preferable that 50% or more of $R^5$ and $R^6$ are the methyl groups, respectively, and it is more preferable that all of $R^5$ and $R^6$ are methyl groups, because synthesis and handling are easy and excellent heat resistance is easily obtained.

Component (c)

Examples of the catalyst to be used for forming the silicone rubber include a hydrosilylation catalyst for accelerating a curing reaction. As the hydrosilylation catalyst, for example, known substances such as platinum compounds and rhodium compounds can be used. The amount of the catalyst blended can be appropriately set, and is not particularly limited.

Component (d)

The thermal capacity per unit volume of the metallic silicon particles is about 1.7 $MJ/m^3 \cdot K$. This value is smaller than about 3.0 $MJ/m^3 \cdot K$ which is the thermal capacity per unit volume of alumina that is widely used for enhancing thermophysical properties of elastic layers containing silicone rubber. In addition, thermal conductivity of the metallic silicon particles is as high as about 150 $W/m \cdot K$.

It is preferable that the particle size of the metallic silicon particles is in a range of 1 μm to 20 μm in terms of volume average particle diameter. By controlling the volume average particle diameter in the aforementioned range, larger amount of the metallic silicon particles can be contained in the elastic layer, and an influence of the metallic silicon particles on the surface smoothness of the elastic layer can be effectively suppressed. The volume average particle diameter of the metallic silicon particles can be determined by use of, for example, a laser diffraction scattering type particle size distribution measurement apparatus.

In addition, the metallic silicon particles may also be subjected to appropriate surface treatment, for the purpose of enhancing the thermal stability, a compounding property and the durability of the silicone rubber composition. Specifically, the surface oxide film may be formed by thermal oxidation or oxidation by water washing.

It is preferable to control the amount (content) of the metallic silicon particles blended to 35% by volume or more and 45% by volume or less, with respect to the total volume of the cured product (elastic layer) that is obtained from the liquid silicone rubber composition. When the amount is 35% by volume or more, the elastic layer can be expected to have high thermal conductivity, and when the amount is 45% by volume or less, the elastic layer can obtain sufficient hardness and strength.

The contents of the cured silicone rubber and the metallic silicon particles in the elastic layer can be checked by use of a thermogravimetric apparatus (TGA) (for example, trade name: TGA/DSC 3+, manufactured by Mettler Toledo International Inc.). The elastic layer is cut out with a razor or the like to collect a specific amount such as 20 mg of a sample, and put the sample in an alumina pan used in the TGA. The alumina pan containing the sample is set in the TGA, and the sample is heated under a nitrogen atmosphere, at a heating rate of 20° C. per minute from room temperature to a temperature of 800° C., and further kept at a constant temperature of 800° C. for 1 hour. The weights before and after the measurement thus obtained are compared, thereby the contents on a mass basis of the cured silicone rubber component and the metallic silicon particles contained in the elastic layer can be calculated. Further, by dividing the mass-based content of the metallic silicon particles by the specific gravity of the metallic silicon, and by dividing the mass based content of the cured silicone rubber component by a specific gravity of the cured silicone rubber, a content ratio of the metallic silicon particles in the elastic layer can be calculated.

Alternatively, the content of the metallic silicon particles can also be obtained by subjecting a cross section of the elastic layer to energy dispersive X-ray spectroscopy (EDS) (for example, trade name: X-MAXN80, manufactured by Oxford Instruments), and converting the obtained area ratio to a volume ratio.

Furthermore, the content of the metallic silicon particles in such an elastic layer can be adjusted by a charging ratio (on volume basis) of the metallic silicon particles at the time of preparing the liquid silicone rubber composition. In this case, the content of the metallic silicon particles can be adjusted by the volume ratio between the silicone component excluding volatile components such as a solvent and the metallic silicon particles.

In addition to the above components, the previously described liquid silicone rubber composition can contain reinforcing fillers such as fumed silica, precipitated silica, fused silica, spherical silica by a sol-gel method, and crystalline silica, as needed. The liquid silicone rubber composition can further contain a heat resistance improver such as iron oxide or cerium oxide, a reaction controller such as a nitrogen compound or an acetylene compound, and the like. These components can be arbitrarily blended in such a range as not to impair the effects of the present disclosure.

Methods for preparing a liquid silicone rubber composition that can increase the amount of the bound rubber of the metallic silicon particles, in other words, a liquid silicone rubber composition that satisfies the requirement of the mass reduction rate according to the present disclosure include the following. Here, in the present disclosure, the metallic silicon particles before blending with the liquid silicone rubber components, may be referred to as "metallic silicon powder".

(i) A method of mixing a liquid silicone component containing an organopolysiloxane and a metallic silicon powder, and then allowing the mixture to stand still for a long period of time (ii) A method of setting conditions of mixing a liquid silicone component containing an organopolysiloxane and a metallic silicon powder to a low shear and a long period of time The details will be described below.

(i) A method of mixing a liquid silicone component containing an organopolysiloxane and a metallic silicon powder, and then allowing the mixture to stand still for a long period of time When a liquid silicone rubber composition is left to stand in which the liquid silicone rubber component containing an organopolysiloxane is mixed with a metallic silicon powder, the amount of the bound rubber increases with time. By the liquid silicone rubber composition being left to stand for 30 days or longer, the bound rubber is sufficiently formed, and the strength of the cured product is enhanced. As a method of mixing the liquid silicone rubber component with the metallic silicon powder, there can be used, for example, a planetary mixer, a rotation/revolution type mixer, a kneader and the like. A temperature at the time of mixing may be a normal temperature such as for example 23 to 25° C. or a high temperature such as for example 100 to 200° C. When mixing is performed at a high temperature, the component (a) and the component (d) may be mixed in advance to prepare a base compound, and then another component may be mixed therein. In addition, the temperature at the time of being left of the liquid silicone rubber composition to stand may also be the normal temperature, or may be the high temperature.

The bound rubber that is formed by rubber types which are used in the tire industry is usually formed in several hours to several days. In contrast to this, in the silicone rubber composition according to the present disclosure, it takes a long period of time to form the bound rubber, as described above. The reason for this is that carbon black which is a filler blended into the rubber that is used in the tire industry has a particle size as small as several tens of nm, tends to easily form a secondary structure, and also has a very large surface area. Because of this, the bound rubber is formed on the surface of the carbon black in a relatively short period of time. On the other hand, the metallic silicon particles have a larger particle size and a smaller surface area in comparison with the carbon black, and accordingly it is considered that it takes a longer time to form a sufficient amount of the bound rubber.

(ii) A method for allowing the conditions at the time when a liquid silicone component containing an organopolysiloxane is mixed with a metallic silicon powder to be a low shear and a long time. Here, as a row material of the metallic silicon As an apparatus for mixing the liquid silicone component containing an organopolysiloxane and the metallic silicon powder, a planetary mixer is often used. The planetary mixer referred to herein is a device having one or a plurality of stirring blades, in which the stirring blades rotate and revolve to give a shearing force by the planetary motion to mix the materials.

In general, when the planetary mixer is employed to prepare the liquid silicone rubber composition, the revolution speed may be set to 40 to 200 rpm, the rotation speed is set to about twice the revolution speed, and the mixing time is set to about 5 to 40 minutes, in many cases. However, according to the study by the present inventors, it is preferable to set the revolution speed to an extremely low speed of 5 to 15 rpm, more preferably of 8 to 12 rpm, and most preferably of 10 rpm. In addition, it is preferable to set the mixing time to 100 to 300 minutes. After the liquid silicone rubber composition has been prepared in this way, the liquid silicon rubber composition is left to stand for 4 days or longer, and preferably for about 4 to 6 days. Through a process like this, a sufficient amount of the bound rubber is formed on the metallic silicon particles. The reason for this is not clear, but it is assumed that a silicone polymer permeates into minute gaps or defects on the surface of the metallic silicon particles by a capillary phenomenon or the like, and the sufficient bound rubber is formed. It is considered that due to the shear rate being increased, wetting of the silicone polymer onto the surface of the metallic silicon particles is not promoted, and the capillary phenomenon decreases, which have affected the amount of the bound rubber.

As described above, the methods for obtaining the liquid silicone rubber composition that provides the elastic layer having the mass reduction rate of 0.05% or more according to the present disclosure includes: a method of producing the liquid silicone rubber composition that includes processes of mixing the silicone component containing an organopolysiloxane with the metallic silicon powder, and allowing the resulting mixture to stand still for 30 days or longer; and a method of producing the liquid silicone rubber composition that includes processes of mixing a silicone component containing an organopolysiloxane with the metallic silicon powder using a planetary mixer under conditions of a revolution speed of 5 to 15 rpm and a mixing time of 100 to 300 minutes, and allowing the obtained mixture to stand still for 4 days or longer.

The amount of the bound rubber of the metallic silicon particles in the elastic layer can be determined by (i) collecting 2 g of a sample from the elastic layer; (ii) immersing the sample into 50 ml of a normal propyl bromide liquid containing dodecylbenzene sulfuric acid at a concentration of 10 wt % and having a temperature of 40° C., and applying an ultrasonic wave of 40 kHz for 60 minutes to dissolve the silicone rubber of the sample; (iii) extracting the metallic silicon particles, and then subjecting the metallic silicon particles extracted to vacuum filtration washing three times with 10 ml of toluene at a temperature of 25° C.; and (iv) subjecting the metallic silicon particles resulting from the step (iii) to a thermogravimetric analysis and measuring the mass reduction rate in temperature range of from 300° C. to 500° C.

That is, 2 g of a sample containing the metallic silicon particles is collected from the elastic layer, and is immersed in 50 ml of a normal propyl bromide liquid containing dodecylbenzene sulfuric acid at a concentration of 10 wt % and having a temperature of 40° C. For information "eSolve 21RS" (trade name, produced by Kaneko Chemical Co., Ltd.) has been used as the normal propyl bromide liquid. Then, the immersed sample is washed under application of ultrasonic waves of 40 kHz, for 60 minutes. The cured silicone rubber is dissolved by the application of the ultrasonic waves, and the metallic silicon particles having the bound rubber are extracted. Next, the metallic silicon particles are subjected to vacuum filtration washing by using Kiriyama funnel having a diameter of 40 mm and filter paper No. 5C (retained particle 1 μm) for the Kiriyama funnel, by 10 ml of toluene at a temperature of 25° C., 3 times, and the resultant metallic silicon particles are separated. The silicone rubber is soluble in toluene, and accordingly the silicone rubber is removed which is not strongly adsorbed to the metallic silicon particles. The obtained metallic silicon particles are dried at a temperature of 120° C. for 1 hour, and 50 mg thereof is weighed and subjected to the TGA measurement. Specifically, the weighed metallic silicon particles are heated at 5° C./min from a temperature of 50° C. to a temperature of 500° C., under dry air of 80 ml/min, and the change in mass at that time is measured. The mass reduction rate (%) in a temperature range between 300° C. and 500° C. is calculated from the obtained data on the mass change. The data on the mass change at a temperature lower than 300° C. is affected by remaining moisture and toluene, and accordingly, the mass change in a temperature range of 300° C. to 500° C. is regarded as the amount of the bound rubber that strongly adsorbs to the metallic silicon powder. In a temperature range of 300 to 500° C., the weight of the metallic silicon powder alone does not almost change, or the metallic silicon powder is slightly oxidized, and the mass increases. In contrast to this, as for the metallic silicon particles to which the silicone rubber strongly adsorbs, a decrease in mass is observed, because the silicone rubber is decomposed at a temperature of about 300° C. For information, as an apparatus to be used for the TGA measurement, for example, a thermogravimetry/differential heat simultaneously measuring apparatus (trade name: TGA/DSC 3+, manufactured by Mettler Toledo International Inc.) can be used.

As for the rupture energy of the elastic layer, the elastic layer is cut out with a punching die (dumbbell shape No. 8 specified in JIS K6251:2004), and the thickness of the rubber in the vicinity of the center is measured, which is a measurement point. Next, the cut elastic layer is tested by using a tensile tester (device name: Strograph EII-L1, manufactured by Toyo Seiki Seisaku-sho, Ltd.) at a tensile speed of 500 mm/min at room temperature, until the sample is ruptured. The rupture energy is calculated from the rupture profile. The rupture energy is calculated as an average value of four samples.

(4) Adhesive Layer

The adhesive layer is a layer for bonding the elastic layer and the surface layer. An adhesive to be used for the adhesive layer can be appropriately selected from known adhesives and used, and is not particularly limited. However, from the viewpoint of ease of handling, it is preferable to use an addition-curable type silicone rubber that contains a self-adhesive component. This adhesive can contain, for example, a self-adhesive component, an organopolysiloxane having a plurality of unsaturated aliphatic groups represented by a vinyl group in the molecular chain, a hydrogen organopolysiloxane, and a platinum compound serving as a cross-linking catalyst. By the curing of the adhesive by an addition reaction, which has been applied to the surface of the elastic layer, an adhesive layer can be formed which bonds the surface layer to the elastic layer.

Note that examples of the above self-adhesive component include the following substances.

Silanes having at least one, preferably two or more functional groups selected from the group consisting of alkenyl groups such as vinyl groups, (meth)acryloxy groups, hydrosilyl groups (SiH groups), epoxy groups, alkoxysilyl groups, carbonyl groups and phenyl groups.

Organosilicon compounds such as cyclic or linear siloxanes having 2 or more and 30 or less silicon atoms, and preferably 4 or more and 20 or less silicon atoms.

Non-silicon-based organic compounds (specifically that do not contain a silicon atom in the molecule), which may contain an oxygen atom in the molecule. However, the organic compounds contain one or more and four or less, preferably one or more and two or less aromatic rings such as a phenylene structure, in one molecule. The phenylene structure has a valency of one or more and four or less, and preferably of two or more and 4 or less. Furthermore, the phenylene structure contains at least one functional group (for example, alkenyl group and (meth)acryloxy group) in one molecule, which can contribute to a hydrosilylation addition reaction, and preferably contains two or more and four or less functional groups.

The above self-adhesive component may be used alone, or in combination with other one or more types. In addition, a filler component can be added to the adhesive within a range that conforms to the gist of the present disclosure, from the viewpoint of adjusting the viscosity and ensuring the heat resistance. Examples of the filler component include the following substances.

Silica, alumina, iron oxide, cerium oxide, cerium hydroxide, carbon black and the like.

The amount of each component blended, which is contained in the adhesive, is not particularly limited and can be appropriately set.

Such addition-curable type silicone rubber adhesives are commercially available and can be easily obtained. It is preferable that the thickness of the adhesive layer is 20 μm or smaller. Due to the thickness of the adhesive layer being set to 20 μm or smaller, the heat resistance can be easily set to be small, and heat from an inner surface side can be efficiently transferred to a recording medium, when the electrophotographic member according to the present aspect is used as a heating belt for the thermal fixing apparatus.

(5) Surface Layer

It is preferable that the surface layer contains a fluororesin in order to allow the electrophotographic member to exhibit a function serving as a release layer for preventing toner from adhering to the outer surface. For the formation of the surface layer, for example, a member obtained by forming a resin illustrated below into a tubular shape can be used.

Tetrafluoroethylene-perfluoro(alkyl vinyl ether) copolymer (PFA), polytetrafluoroethylene (PTFE), tetrafluoroethylene-hexafluoropropylene copolymer (FEP), and the like.

Among the resin materials illustrated above, PFA is particularly preferably used, from the viewpoint of the formability and the releasability of toner.

It is preferable that the thickness of the surface layer is 10 μm or larger and 50 μm or smaller. When the thickness of the surface layer is controlled within this range, it is easy to maintain an appropriate surface hardness of the electrophotographic member.

(6) Method for Manufacturing Electrophotographic Member

The electrophotographic member according to the present disclosure can be manufactured, for example, by a manufacturing method including the following processes.

Process for preparing base body

The above base body is prepared, and is fixed to a jig or the like for holding the shape as needed.

The surface of the base body facing the elastic layer may be subjected to surface treatment, so as to be imparted with a function such as adhesiveness to the elastic layer. Examples of the surface treatment include: physical treatments such as blasting treatment, lapping treatment, and polishing; and chemical treatments such as oxidation, coupling agent treatment, and primer treatment. In addition, physical treatment and chemical treatment may be used in combination.

In particular, it is preferable to treat the outer surface of the base body with a primer in order to improve adhesiveness between the base body and the elastic layer, because an elastic layer to be used contains cross-linked silicone rubber. As the primer, for example, a primer having a paint state can be used in which an additive is appropriately blended and dispersed in an organic solvent. Such primers are commercially available. Examples of the above additive include a silane coupling agent, a silicone polymer, a hydrogenated methyl siloxane, an alkoxysilane, an accelerating catalyst of reactions such as hydrolysis, condensation and addition, and a coloring agent such as iron oxide. This primer is applied to the outer surface of the base body, and passes through processes of drying and baking; and the primer treatment is finished.

The primer can be appropriately selected according to, for example, the material of the base body, the type of the elastic layer, and a reaction form in cross-linking. For example, when the material constituting the elastic layer contains a large amount of unsaturated aliphatic groups, a material containing a hydrosilyl group is preferably used as the primer, so as to impart the adhesiveness by a reaction with the unsaturated aliphatic groups. On the other hand, when the material constituting the elastic layer contains many hydrosilyl groups, a material containing an unsaturated aliphatic group is preferably used as the primer. In addition to the above, according to the types of the base body and the elastic layer which are adherends, such as a material containing an alkoxy group and the like, the primer can be appropriately selected.

Elastic layer forming process

The elastic layer forming process can include the following processes.

(i) A process of preparing the above liquid silicone rubber composition.

(ii) A process of applying the composition onto the base body, by a method such as a blade coating method, a nozzle coating method or a ring coating method to form a layer of the composition.

(iii) A process of curing the layer of the composition to form the elastic layer.

Adhesive layer forming process

Figure 2:
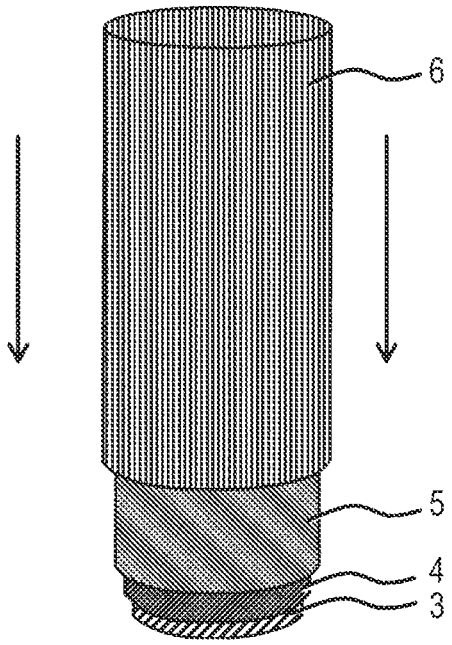
FIG. 2 illustrates a schematic view of one example of a process of laminating a surface layer.

FIG. 2 illustrates a schematic view illustrating an example of a process of laminating the surface layer 6 on the elastic layer 4 containing silicone rubber, via the adhesive layer 5 that is formed by use of an addition-curable type silicone rubber adhesive. Firstly, an adhesive is applied to the surface of the elastic layer 4 that is formed on the outer peripheral surface of a base body 3. As for the adhesive, the constitution of each component contained in the adhesive, and the amount of the adhesive and the components blended, the description in the previously described (4) adhesive layer is applied thereto.

By the curing of the adhesive by an addition reaction, which has been applied to the surface of the elastic layer, the adhesive layer can be formed which bonds the surface layer to the elastic layer.

It is preferable that the thickness of the adhesive layer is 20 μm or smaller. Due to the thickness of the adhesive layer being set to 20 μm or smaller, the heat resistance can be easily set to be small, and heat from an inner surface side can be efficiently transferred to a recording medium, when the electrophotographic member according to the present aspect is used as a heating belt in the thermal fixing apparatus.

Furthermore, the outer surface thereof is covered with a fluorine resin tube for forming the surface layer 6, and is thereby laminated. Note that when the inner surface of the fluororesin tube is subjected to sodium treatment, excimer laser treatment, ammonia treatment or the like in advance, the adhesiveness can be enhanced. As the fluororesin tube, the material and thickness illustrated in the previously described (5) can be applied.

It is preferable that the thickness of the surface layer is 10 μm or larger and 50 μm or smaller. When the thickness of the surface layer is controlled within this range, it is easy to maintain an appropriate surface hardness of the electrophotographic member.

The method for covering the fluororesin tube is not particularly limited, and there are usable methods of covering the elastic layer while using the addition-curable type silicone rubber adhesive as a lubricant, and of covering the elastic layer with the fluororesin tube from the outside, which has been expanded. In addition, the excess addition-curable type silicone rubber adhesive that remains between the elastic layer 4 and the surface layer 6 formed of the fluororesin tube can also be removed by being squeezed out by use of an unillustrated unit. It is preferable that the thickness of the adhesive layer 5 after having been squeezed out is 20 μm or smaller, from the viewpoint of heat transfer properties.

Next, the addition-curable type silicone rubber adhesive is cured and bonded by being heated by a heating unit such as an electric furnace for a predetermined time, and thereby the adhesive layer 5 and the surface layer 6 can be formed on the elastic layer 4. For information, the conditions such as a heating time and a heating temperature can be appropriately set according to the adhesive or the like which has been used. Both end portions of the obtained member in the width direction are cut into desired lengths, and thereby the electrophotographic member can be obtained.

A thermal fixing apparatus that is manufactured by using the electrophotographic member having the elastic layer of the present disclosure will be described in detail below, based on specific configurations.

Thermal fixing apparatus

The thermal fixing apparatus according to the present disclosure is configured so that rotating bodies such as a pair of heated roller and roller, a belt and a roller, and a belt and a belt are brought into pressure contact with each other. The type of thermal fixing apparatus is appropriately selected in consideration of conditions such as the process speed, size and the like of a whole electrophotographic image forming apparatus on which the thermal fixing apparatus is mounted.

In the thermal fixing apparatus, the heated heating member and the pressing member are brought into pressure contact with each other to form a fixing nip, and the fixing nip is allowed to sandwich and convey a recording medium on which an image is formed by unfixed toner and which serves as a body to be heated. The image formed by the unfixed toner is referred to as a toner image. The toner image is heated and pressurized by the fixing nip of the thermal fixing apparatus. As a result, the toner image is melted and the colors are mixed; and after that, the resultant toner image is cooled, and is thereby fixed as an image on the recording medium.

Specific examples of the thermal fixing apparatus will be described below with reference to the drawings, but the scope and application of the present disclosure are not limited thereto.

Heating belt-pressing belt type of thermal fixing apparatus

Figure 3:
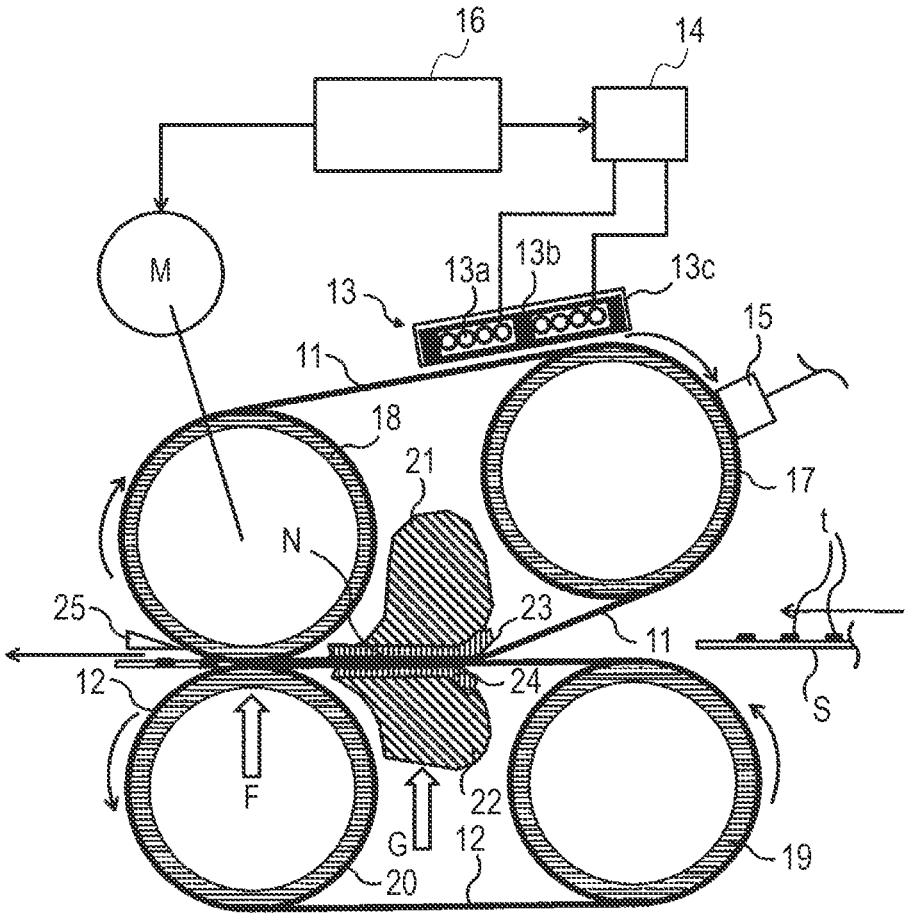
FIG. 3 illustrates a schematic cross-sectional view of one example of a heating belt-pressing belt type of thermal fixing apparatus.

FIG. 3 illustrates a schematic cross-sectional view of one example of the thermal fixing apparatus that is a so-called twin belt type thermal fixing apparatus in which rotating bodies such as a pair of heating belt 11 and pressing belt 12 are brought into pressure contact with each other, and has the heating belt as a heating member. Here, the width direction of the thermal fixing apparatus or members constituting the thermal fixing apparatus is a direction perpendicular to the paper surface of FIG. 3. A front face for the thermal fixing apparatus is a face on an introduction side of the recording medium S. Left and right are left or right at the time when the apparatus is viewed from the front. The width of the belt is a belt dimension in the left-right direction at the time when the apparatus is viewed from the front. The width of the recording medium S is a dimension of the recording medium in a direction orthogonal to the conveyance direction. Furthermore, the upstream or downstream refers to upstream or downstream with respect to the conveyance direction (arrow direction) of the recording medium.

The thermal fixing apparatus includes a heating belt 11 serving as the fixing member, and a pressing belt 12. Each of the heating belt 11 and the pressing belt 12 is a heating belt as illustrated in FIG. 1A, which contains a base body that is formed of a metal containing nickel as a main component, and has flexibility; and is stretched between two rollers.

The heating belt 11 employs a heating source (induction heating member 13, excitation coil) that can heat the heating belt by electromagnetic induction heating having high energy efficiency, as a heating unit. The induction heating member 13 includes an induction coil 13*a*, an excitation core 13*b*, and a coil holder 13*c* that holds the coil and the core. The induction coil 13*a* uses a litz wire that is flatly wound in an elliptical shape, and is arranged in a lateral E-shaped excitation core 13*b* which has protrusions in the center and in both sides of the induction coil 13*a*. A material having high permeability and low residual magnetic flux density, such as ferrite or permalloy, is used for the excitation core 13*b*, accordingly, losses in the induction coil 13*a* and the excitation core 13*b* are suppressed, and the heating belt 11 can be efficiently heated.

When a high-frequency current flows from an excitation circuit 14 to the induction coil 13*a* of the induction heating member 13, the base body of the heating belt 11 generates induction heat, and the heating belt 11 is heated from a base body side. The surface temperature of the heating belt 11 is detected by a temperature detecting element 15 such as a thermistor. A signal concerning the temperature of the heating belt 11, which is detected by the temperature detecting element 15, is sent to a control circuit section 16. The control circuit section 16 controls an electric power to be supplied from the excitation circuit 14 to the induction coil 13*a* so that the temperature information sent from the temperature detection element 15 is kept at a predetermined fixing temperature, and thereby adjusts the temperature of the heating belt 11 to the predetermined fixing temperature.

The heating belt 11 is stretched by a roller 17 serving as a belt rotating member, and a heating-side roller 18. The roller 17 and the heating-side roller 18 are each rotatably supported between unillustrated left and right-side plates of the apparatus.

The roller 17 is a hollow roller which has an outer diameter of 20 mm, an inner diameter of 18 mm, and a thickness of 1 mm, for example, and is made from iron, and functions as a tension roller that gives a tension to the heating belt 11. The heating-side roller 18 is such an elastic roller having high slidability that a silicone rubber layer serving as an elastic layer is provided on a core metal which has an outer diameter of 20 mm and an inner diameter of 18 mm, for example, and is made from an iron alloy.

Into this heating-side roller 18 serving as a driving roller, a driving force is input from a driving source (motor)M via an unillustrated driving gear train, and the roller is rotationally driven at a predetermined speed in a clockwise direction indicated by the arrow. The heating-side roller 18 is provided with the elastic layer as described above, thereby can satisfactorily transmit the driving force that is input into the heating-side roller 18 to the heating belt 11, and can also form a fixing nip for ensuring separability of the recording medium from the heating belt 11. Due to the elastic layer provided on the heating-side roller 18, the heat conduction to the heating-side roller is reduced, which consequently produces also an effect of shortening the warm-up time.

When the heating-side roller 18 is rotationally driven, the heating belt 11 rotates together with the roller 17 due to friction between the surface of the elastic layer of the heating-side roller 18 and the inner surface of the heating belt 11. The arrangements and sizes of the roller 17 and the heating-side roller 18 are selected so as to match the size of the heating belt 11.

For example, the dimensions of the above roller 17 and the heating-side roller 18 are selected so that the heating belt 11 can be stretched which has an inner diameter of 55 mm when the heating belt 11 is not mounted.

The pressing belt 12 is stretched by a tension roller 19 serving as a belt rotating member, and a pressing-side roller 20. The inner diameter of the pressing belt at the time when being not mounted is 55 mm, for example. The tension roller 19 and the pressing-side roller 20 are each rotatably supported between unillustrated left and right-side plates of the apparatus.

The tension roller 19 has a core metal made from an iron alloy having an outer diameter of 20 mm and an inner diameter of 16 mm, for example, and has a silicone sponge layer provided on the core metal, in order to reduce thermal conductivity and decrease heat conduction from the pressing belt 12. The pressing-side roller 20 is a rigid roller that has an outer diameter of 20 mm, an inner diameter of 16 mm and a thickness of 2 mm, for example, is made from an iron alloy, and has low slidability. The dimensions of the tension roller 19 and the pressing-side roller 20 are also selected so as to match the dimensions of the pressing belt 12.

Here, the pressing-side roller 20 is pressurized toward the heating-side roller 18 in a direction of the arrow F, by a predetermined pressing force that is caused by an unillustrated pressing mechanism which works on both left and right end sides of the rotation shaft of the pressing-side roller 20, so as to form a nip portion N between the heating belt 11 and the pressing belt 12.

In addition, a pressing pad is adopted so that a wide nip portion N is obtained without increasing the size of the apparatus. Specifically, the pressing pad includes a fixing pad 21 serving as a first pressing pad that pressurizes the heating belt 11 toward the pressing belt 12, and a pressing pad 22 serving as a second pressing pad that pressurizes the pressing belt 12 toward the heating belt 11. The fixing pad 21 and the pressing pad 22 are supported and arranged between the unillustrated left and right-side plates of the apparatus. The pressing pad 22 is pressurized toward the fixing pad 21 by the predetermined pressing force in a direction of the arrow G, which is caused by an unillustrated pressing mechanism. The fixing pad 21 that is the first pressing pad includes a pad base body and a sliding sheet (low friction sheet) 23 in contact with the belt. The pressing pad 22 that is the second pressing pad also has a pad base body and a sliding sheet 24 in contact with the belt. This is because there is a problem that the abrasion of the portion becomes large which rubs against the inner peripheral surface of the belt of the pad. Due to the sliding sheets 23 and 24 being interposed between the belt and the pad base body, the abrasion of the pad can be prevented, sliding resistance can also be reduced, and accordingly a satisfactory running performance of the belt and the durability of the belt can be secured.

For information, a non-contact type discharging brush (unillustrated) is provided for the heating belt 11, and a contact type discharging brush (unillustrated) is provided for the pressing belt, respectively.

The control circuit section 16 drives the motor M at least when image formation is executed. Thereby, the heating-side roller 18 is rotationally driven, and the heating belt 11 is rotationally driven in the same direction. The pressing belt 12 is driven by the heating belt 11 and thereby rotates. Here, the roller pair 18 and 20 is configured to sandwich and convey the heating belt 11 and the pressing belt 12 at the most downstream portion of the fixing nip, and thereby can prevent slipping of the belts. The most downstream portion of the fixing nip is a portion at which the pressure distribution (in conveyance direction of recording medium) in the fixing nip becomes maximum.

In a state in which the heating belt 11 is raised to and maintained at a predetermined fixing temperature (referred to as temperature control), the recording medium S having an unfixed toner image t thereon is conveyed to the nip portion N between the heating belt 11 and the pressing belt 12 (arrow direction). The recording medium S is introduced in a state in which the surface carrying the unfixed toner image t thereon faces the heating belt 11 side. Then, the recording medium S is sandwiched and conveyed in a state in which the unfixed toner image t comes in close contact with the outer peripheral surface of the heating belt 11, and thereby heat is given from the heating belt 11, and a pressing force is applied; and the unfixed toner image t is fixed on the surface of the recording medium S. At this time, the heat from the heated base body of the heating belt 11 is efficiently transported toward the recording medium S through the elastic layer of which the thermal conductivity in the thickness direction is enhanced. After that, the recording medium S is separated from the heating belt by a separation member 25, and is conveyed (arrow direction).

Heating belt-pressing roller type of thermal fixing apparatus

Figure 4:
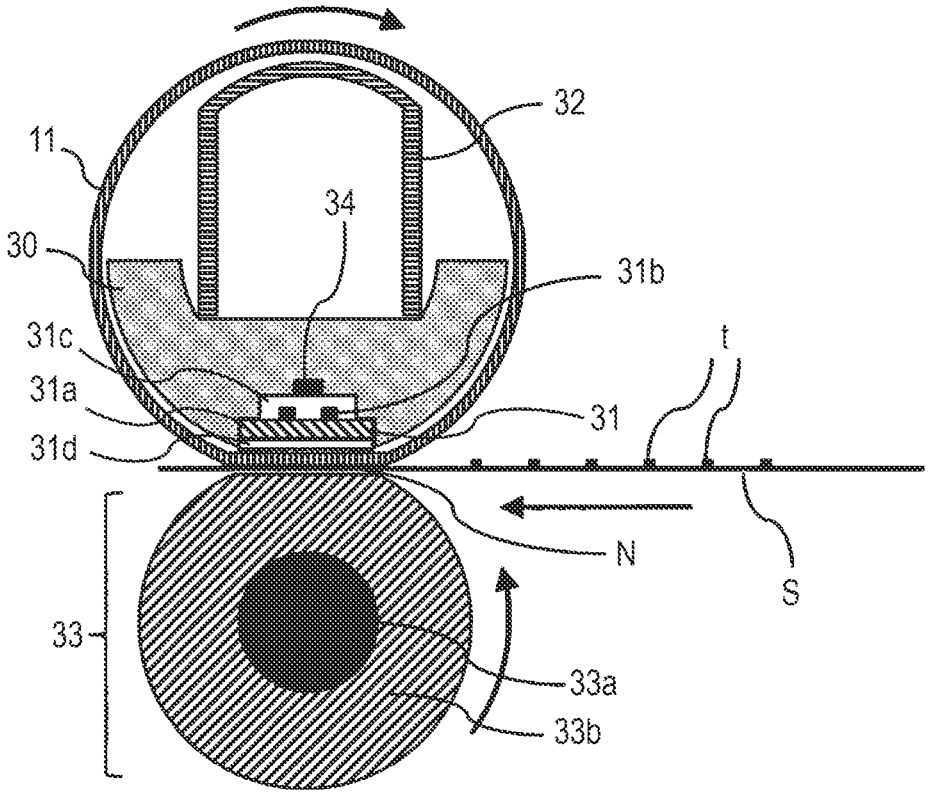
FIG. 4 illustrates a schematic cross-sectional view of one example of a heating belt-pressing roller type of thermal fixing apparatus.

FIG. 4 illustrates a schematic view illustrating an example of a heating belt-pressing roller type of thermal fixing apparatus that uses a ceramic heater as a heating body. In FIG. 4, reference numeral 11 denotes a heating belt having a cylindrical shape or an endless belt shape, and can employ the fixing member according to the present disclosure. There is a heat-resistant and heat-insulating belt guide 30 for holding the heating belt 11. At a position (substantially central portion of lower surface of belt guide 30) in contact with the heating belt 11, a ceramic heater 31 for heating the heating belt 11 is fitted into a groove portion that is formed and provided along the longitudinal direction of the guide, and is fixedly supported. In addition, the heating belt 11 is loosely fitted around the belt guide 30. In addition, a rigid stay 32 for pressurization is inserted into the inside of the belt guide 30.

On the other hand, a pressing roller 33 is arranged so as to face the heating belt 11. Note that the pressing roller 33 is an elastic pressing roller in the present disclosure, specifically is a roller in which an elastic layer **33*b* of silicone rubber is provided on a core metal 33*a* to reduce the hardness. The core metal 33*a*** is arranged in such a way that both end portions thereof are rotatably bearing-held between unillustrated plates in a front side and a chassis side in a rear side of the apparatus. For information, the elastic pressing roller is covered with a PFA (tetrafluoroethylene/perfluoroalkyl ether copolymer) tube so as to enhance the surface property.

Pressing springs (unillustrated) are provided in a compressed state between both end portions of the rigid stay 32 for pressurization and spring receiving members (unillustrated) on the chassis side of the apparatus, respectively, and thereby exert a pushing down force on the rigid stay 32 for pressurization. Thereby, the lower surface of the ceramic heater 31 that is arranged on the lower surface of the belt guide 30 made from a heat-resistant resin and the upper surface of the pressing roller 33 are brought into pressure contact with each other while sandwiching the heating belt 11 therebetween, and form a fixing nip portion N.

The pressing roller 33 is rotationally driven by an unillustrated driving unit in a counterclockwise direction as indicated by the arrow. A rotational force acts on the heating belt 11 due to a frictional force between the pressing roller 33 and the outer surface of the heating belt 11, which is generated by the rotational driving of the pressing roller 33. The inner surface of the heating belt 11 comes in close contact with the lower surface of the ceramic heater 31 at the fixing nip portion N. Then, the heating belt 11 in close contact with the lower surface of the ceramic heater 31 rotates around the belt guide 30 at a peripheral speed substantially corresponding to the rotational peripheral speed of the pressing roller 33, in a clockwise direction as indicated by the arrow, while sliding in a close contact state (pressing roller driving method).

The rotation of the pressing roller 33 is started based on the print start signal, and the heating of the ceramic heater 31 is started. The rotational peripheral speed of the heating belt 11 by the rotation of the pressing roller 33 is stabilized, and the temperature of a temperature detection element 34 provided on the upper surface of the ceramic heater rises to a predetermined temperature, for example, 180° C. At that moment, the recording medium S carrying the unfixed toner image t thereon, which is a material to be heated, is introduced between the heating belt 11 and the pressing roller 33 at the fixing nip portion N, in the direction of the arrow, in such a state that the toner image carrying surface side faces the heating belt 11 side. Then, the recording medium S comes in close contact with the lower surface of the ceramic heater 31 via the heating belt 11 in the fixing nip portion N, and moves and passes through the fixing nip portion N together with the heating belt 11. In the process of moving and passing, the heat of the heating belt 11 is applied to the recording medium S, and the toner image t is heated and fixed on the surface of the recording medium S. The recording medium S that has passed through the fixing nip portion N is separated from the outer surface of the heating belt 11 and is conveyed.

The ceramic heater 31 serving as the heating body is a horizontally long and linear heating body having a low thermal capacity of which the longitudinal direction is a direction orthogonal to the moving direction of the heating belt 11 and the recording medium S. It is preferable that the ceramic heater 31 has a configuration basically including: a heater substrate 31*a*; a heat generating layer 31*b* that is provided on the surface of the heater substrate 31*a* along the longitudinal direction thereof; a protection layer 31*c* provided further thereon; and a sliding member 31*d*. Here, the heater substrate 31*a* can be formed from aluminum nitride or the like. The heat generating layer 31*b* can be formed by application of an electric resistance material, for example, such as Ag/Pd (silver/palladium), for about 10 μm with a width of 1 to 5 mm, by screen printing or the like. The protection layer 31*c* can be formed from glass, a fluororesin or the like. Note that the ceramic heater to be used in the thermal fixing apparatus is not limited to the above structure.

Then, an electric current is applied between both ends of the heat generating layer 31*b* of the ceramic heater 31, thereby the heat generating layer 31*b* generates heat, and the temperature of the heater 31 rises rapidly. The ceramic heater 31 is fixed and supported by being fit into the groove portion that is formed and provided in a substantially central portion of the lower surface of the belt guide 30 along the longitudinal direction of the guide, in a state in which the protection layer 31*c* side faces upward. In the fixing nip portion N in contact with the heating belt 11, the surface of the sliding member 31*d* of the ceramic heater 31 and the inner surface of the heating belt 11 slide while coming in contact with each other.

As described above, in the heating belt 11, the thermal conductivity in the thickness direction of the elastic layer containing silicone rubber is enhanced, and the hardness is also reduced. Due to such a configuration, the heating belt 11 can efficiently heat the unfixed toner image and can fix a high-quality image on the recording medium S at the time of fixing nip, because of having low hardness.

According to one aspect of the present disclosure, the electrophotographic member can be obtained that has high heat conduction, low thermal capacity, and further excellent durability. In addition, according to one aspect of the present disclosure, the thermal fixing apparatus can be obtained that contributes to stable formation of a high-quality electrophotographic image. Furthermore, according to another aspect of the present disclosure, the electrophotographic image forming apparatus can be obtained that can stably form the high-quality electrophotographic image.

EXAMPLES

The present disclosure will be described below in more detail with reference to Examples.

Example 1

Preparation of Liquid Silicone Rubber Composition

Firstly, as the component (a), 100 parts by mass of a silicone polymer (hereinafter, referred to as "Vi") was prepared that had a vinyl group which was an unsaturated aliphatic group only at both terminals of a molecular chain and had a methyl group as an unsubstituted hydrocarbon group which did not contain other unsaturated aliphatic groups. As the Vi, trade name: DMS V41 was used which was manufactured by Gelest, Inc., and had viscosity of 10000 $mm^2/s$. For information, the silicone polymer is a polymer in which in the structural formula (2), all of $R^3$ are methyl groups and all of $R^4$ are vinyl groups.

Subsequently, this Vi was blended with metallic silicon powder (trade name: M-Si #350WB, produced by Kinsei Matec Co., Ltd., average particle size of 12 μm) of which the surface was oxidized, so as to be 42 vol % with respect to the silicone components, as the component (d). The mixture was set in a rotation/revolution mixer (model ARV-310, manufactured by Thinky Corporation) and was stirred and mixed at 2000 rpm for 4 minutes, and a mixture 1 was obtained.

After that, the mixture 1 was stationarily stored at normal temperature for 180 days.

Next, the materials were weighed that were 0.22 parts by mass of an IPA solution of 90 wt % 1-ethynyl-1-cyclohexanol (produced by Tokyo Chemical Industry Co., Ltd.) which is a curing retardant, 0.1 parts by mass of a hydrosilylation catalyst (platinum catalyst: mixture of 1,3-divinyltetramethyldisiloxane platinum complex, 1,3-divinyltetramethyldisiloxane, and 2-propanol) of the component (c), and further 1.5 parts by mass of a silicone polymer that had a straight-chain siloxane skeleton and has an active hydrogen group bonded to silicon only in side chains (trade name: HMS-301, produced by Gelest Inc., and viscosity of 30 $mm^2/s$), as the component(b); the weighed materials were added to the mixture 1; the resultant mixture was set in a rotation/revolution mixer (model ARV-310, manufactured by Thinky Corporation), was stirred and mixed under reduced pressure at 600 rpm for 4 minutes; and a liquid silicone rubber composition was obtained.

Preparation of Sample Sheet

A stainless steel (SUS) film having a thickness of 50 μm was coated with the above liquid silicone rubber composition at a speed of 10 mm/sec so that a film thickness of the composition became 250 μm, by using a film applicator (manufactured by Allgood). After that, the liquid silicone rubber composition was primarily cured by heating at 160° C. for 1 minute, then the resultant silicone rubber composition layer was secondarily cured by heating at a temperature of 200° C. for 30 minutes to prepare a sample sheet of an elastic layer.

Measurement of Mass Reduction Rate

From the above sample sheet of the elastic layer, 2 g of a sample was taken, and was immersed in 50 ml of a normal propyl bromide liquid (trade name: eSolve 21RS, produced by Kaneko Chemical Co., Ltd.) containing dodecylbenzene sulfuric acid at a concentration of 10 wt % and having a temperature of 40° C. Then, the immersed sample was washed under application of ultrasonic waves of 40 kHz, for 60 minutes. Thereby, the cured silicone rubber was dissolved, and the metallic silicon particles were extracted. Next, the obtained metallic silicon particles were subjected to vacuum filtration washing by using Kiriyama funnel having a diameter of 40 mm and filter paper No. 5C (retained particle 1 μm) for the Kiriyama funnel, by 10 ml of toluene at a temperature of 25° C., 3 times. Thus washed metallic silicon particles were dried at a temperature of 120° C. for 1 hour. The dried metallic silicon particles in an amount of 50 mg were weighed and subjected to TGA measurement. As a TGA apparatus, "TGA/DSC 3+" (trade name, manufactured by Mettler Toledo International Inc.) was used; and the temperature was raised at 5° C./min from a temperature of 50° C. to a temperature of 500° C., under dry air of 80 ml/min, and the change in mass at that time was measured. The mass reduction rate (%) in a period between 300° C. and 500° C. was calculated from the obtained data on the mass change. The results are shown in Table 1.

Measurement of Rupture Energy

A test piece was cut out from the above sample sheet of the elastic layer with a punching die (dumbbell shape No. 8 specified in JIS K6251:2004), and the thickness of the rubber in the vicinity of the center was measured, which was a measurement point. Next, the cut test piece was tested by using a tensile tester (device name: Strograph EII-L1, manufactured by Toyo Seiki Seisaku-sho, Ltd.) at a tensile speed of 500 mm/min at room temperature, until a sample was ruptured. The rupture energy was calculated from the rupture profile. The rupture energy was calculated as an average value of four samples which were cut out from the same sample sheet. The results are shown in Table 1.

Comparative Example 1

A sample sheet was prepared in the same manner as in Example 1 except that the stationary storage period was set to 6 days.

Example 2

A sample sheet was prepared in the same manner as in Example 1, except that the material was used as the component (a), which had a viscosity of 5000 $mm^2/s$ (trade name: DMS V35, produced by Gelest Inc.), the amount of metallic silicon of the content (d) blended was set to 40 vol %, and the stationary storage period was set to 46 days.

Comparative Example 2

A sample sheet was prepared in the same manner as in Example 2 except that the stationary storage period was set to 3 hours.

Example 3

The silicone polymer to be used as the component (a) was changed to a trade name: DMS-V42, produced by Gelest Inc. and having a viscosity of 20000 $mm^2/s$. For information, the silicone polymer is a polymer in which in the structural formula (2), all of $R^3$ are methyl groups and all of $R^4$ are vinyl groups.

Subsequently, to this Vi, the metallic silicon of which the surface was oxidized (trade name: M-Si #350WB, produced by Kinsei Matec Co., Ltd., having average particle size of 12 μm) was added as the component (d), so as to become 40% by volume with respect to the silicone component. The mixture was set in a planetary mixer (Hivis Mix 2P-01 type, manufactured by Primix Corporation), and was stirred and mixed at 10 rpm for 160 minutes; and a mixture 2 was obtained. After that, the mixture 2 was stationarily stored at normal temperature for 5 days.

Subsequent procedures were the same as in Example 1, and a sample sheet was prepared.

Comparative Example 3

A sample sheet was prepared in the same manner as in Example 3, except that the mixture of the components (a) and (d) was set in a rotation/revolution mixer (model ARV-310, manufactured by Thinky Corporation), and was stirred and mixed at a 2000 rpm for 4 minutes, in the same manner as in Example 1.

(Evaluation)

Figure 5:
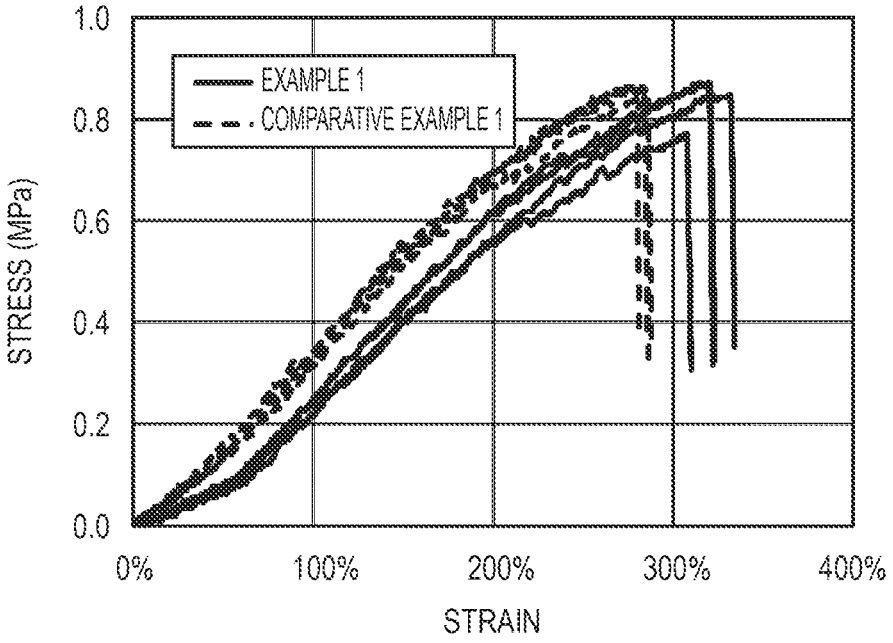
FIG. 5 illustrates a graph illustrating measurement results of tensile rupture tests of Example 1 and Comparative Example 1.

For the sample sheets of Examples 1 to 3 and Comparative Examples 1 to 3, the TGA reduction rate and the rupture energy were measured by the above described method. FIG. 5 illustrates the profile results of the rupture tests of Example 1 and Comparative Example 1.

TABLE 1

| | Component (a) Viscosity ($mm^2$/sec) | Metallic silicon powder: Material name | Metallic silicon powder: Volume average particle diameter (μm) | Metallic silicon powder: Blended amount (% by volume) | Mixing method | Stationary storage period | TGA reduction rate (%) | Rupture energy ($kj/m^2$) |
|---|---|---|---|---|---|---|---|---|
| Example 1 | 10000 | [#350WB] | 12 | 42 | Rotation/revolution mixer | 180 days | 0.064 | 29.3 |
| Comparative Example 1 | 10000 | [#350WB] | 12 | 42 | Rotation/revolution mixer | 6 days | 0.026 | 26.9 |
| Example 2 | 5000 | [#350WB] | 12 | 40 | Rotation/revolution mixer | 46 days | 0.115 | 39.5 |
| Comparative Example 2 | 5000 | [#350WB] | 12 | 40 | Rotation/revolution mixer | 3 hours | 0.021 | 36.0 |
| Example 3 | 20000 | [#350WB] | 12 | 40 | Planetary mixer | 5 days | 0.105 | 45.7 |
| Comparative Example 3 | 20000 | [#350WB] | 12 | 40 | Rotation/revolution mixer | 5 days | 0.041 | 41.2 |

From the results of Table 1, when Examples and Comparative Examples are compared, it is understood that in any of the compositions, the composition which shows a large TGA reduction rate and a large amount of the bound rubber also shows large rupture energy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-021314, filed Feb. 12, 2021, which is hereby incorporated by reference herein in its entirety.

What is claimed is:

1. An electrophotographic member, comprising:

a base body; and an elastic layer on the base body, the elastic layer comprising silicone rubber and metallic silicon particles in the silicone rubber, wherein the metallic silicon particles have a mass reduction rate of 0.05% or more, the mass reduction rate being determined by:

(i) collecting 2 g of a sample from the elastic layer;

(ii) immersing the sample into 50 ml of a normal propyl bromide liquid containing dodecylbenzene sulfuric acid at a concentration of 10 wt % and having a temperature of 40° C., and applying an ultrasonic wave of 40 kHz for 60 minutes to dissolve the silicone rubber of the sample;

(iii) extracting the metallic silicon particles, and then subjecting the metallic silicon particles extracted to vacuum filtration washing three times with 10 ml of toluene at a temperature of 25° C.; and (iv) subjecting the metallic silicon particles resulting from the step (iii) to a thermogravimetric analysis and measuring the mass reduction rate in temperature range of from 300° C. to 500° C.

2. The electrophotographic member according to claim 1, wherein a content of the metallic silicon particles in the elastic layer is 35% by volume to 5% by volume with respect to a total volume of the elastic layer.

3. The electrophotographic member according to claim 1, wherein the metallic silicon particles have a volume average particle diameter of 1 μm to 20 μm.

4. The electrophotographic member according to claim 1, having an endless belt shape or a roller shape.

5. A method for manufacturing the electrophotographic member according to claim 1, comprising:

mixing a silicone component containing organopolysiloxane with a metallic silicon powder to obtain a mixture, and allowing the mixture to stand still for 30 days or longer to prepare a liquid silicone rubber composition;

applying the liquid silicone rubber composition onto the base body to form a layer of the composition; and curing the layer of the composition to form the elastic layer.

6. A method for manufacturing the electrophotographic member according to claim 1, comprising:

mixing a silicone component containing organopolysiloxane with a metallic silicon powder using a planetary mixer under conditions of a revolution speed of 5 to 15 rpm and a mixing time of 100 to 300 minutes to obtain a mixture, and allowing the mixture to stand still for 4 days or longer to prepare a liquid silicone rubber composition;

applying the liquid silicone rubber composition onto the base body to form a layer of the composition; and curing the layer of the composition to form the elastic layer.

7. A thermal fixing apparatus comprising a heating member and a pressing member that heats a recording material having an unfixed toner image thereon at a nip portion that is formed by the heating member and the pressing member to fix the unfixed toner image on the recording material, wherein the heating member is an electrophotographic member comprising a base body and an elastic layer on the base body, wherein the elastic layer comprises silicone rubber and metallic silicon particles in the silicone rubber, and wherein the metallic silicon particles have a mass reduction rate of 0.05% or more, the mass reduction rate being determined by:

(i) collecting 2 g of a sample from the elastic layer;

(ii) immersing the sample into 50 ml of a normal propyl bromide liquid containing dodecylbenzene sulfuric acid at a concentration of 10 wt % and having a temperature of 40° C., and applying an ultrasonic wave of 40 kHz for 60 minutes to dissolve lvc the silicone rubber of the sample;

(iii) extracting the metallic silicon particles, and then subjecting the metallic silicon particles extracted to vacuum filtration washing three times with 10 ml of toluene at a temperature of 25° C.; and (iv) subjecting the metallic silicon particles resulting from the step (iii) to a thermogravimetric analysis and measuring the mass reduction rate in temperature range of from 300° C. to 500° C.

8. An electrophotographic image forming apparatus comprising a thermal fixing apparatus, wherein the thermal fixing apparatus is a thermal fixing apparatus comprising a heating member and a pressing member that heats a recording material having an unfixed toner image thereon at a nip portion that is formed by the heating member and the pressing member to fix the unfixed toner image on the recording material, wherein the heating member is an electrophotographic member comprising a base body and an elastic layer on the base body, wherein the elastic layer comprises silicone rubber and metallic silicon particles in the silicone rubber, and wherein the metallic silicon particles have a mass reduction rate of 0.05% or more, the mass reduction rate being determined by:

(i) collecting 2 g of a sample from the elastic layer;

(ii) immersing the sample into 50 ml of a normal propyl bromide liquid containing dodecylbenzene sulfuric acid at a concentration of 10 wt % and having a temperature of 40° C., and applying an ultrasonic wave of 40 kHz for 60 minutes to dissolve the silicone rubber of the sample;

(iii) extracting the metallic silicon particles, and then subjecting the metallic silicon particles extracted to vacuum filtration washing three times with 10 ml of toluene at a temperature of 25° C.; and (iv) subjecting the metallic silicon particles resulting from the step (iii) to a thermogravimetric analysis and measuring the mass reduction rate in temperature range of from 300° C. to 500° C.

* * * * *